United States Patent [19]

Rush

[11] Patent Number: 4,634,198

[45] Date of Patent: Jan. 6, 1987

[54] ELECTRICAL CONTACT ASSEMBLIES AND COMPONENTS

[75] Inventor: Derek A. Rush, London, England

[73] Assignee: Smiths Industries Public Limited Company, London, England

[21] Appl. No.: 775,184

[22] Filed: Sep. 12, 1985

[30] Foreign Application Priority Data

Sep. 22, 1984 [GB] United Kingdom ..... 8424041

[51] Int. Cl.[4] ..... H01R 9/09

[52] U.S. Cl. ..... 339/17 LC

[58] Field of Search ..... 339/17 R, 17 L, 17 LC, 339/17 LM, 17 M, 17 CF, 176 MP

[56] References Cited

U.S. PATENT DOCUMENTS

| | | | |
|---|---|---|---|
| 3,283,108 | 11/1966 | Collier | 339/17 L |
| 3,307,246 | 3/1967 | Gulliksen et al. | 339/17 R |
| 3,631,380 | 12/1971 | Bohn | 339/17 LM |
| 4,072,387 | 2/1978 | Sochor | 339/91 R |
| 4,410,230 | 10/1983 | San Miguel | 339/17 LC |
| 4,478,471 | 10/1984 | Olsson | 339/74 R |
| 4,494,807 | 1/1985 | Cosmo | 339/17 CF |

OTHER PUBLICATIONS

IBM Bulletin, Schick, vol. 7, No. 1, p. 91, 6-1964.

*Primary Examiner*—Neil Abrams

*Attorney, Agent, or Firm*—Pollock, VandeSande and Priddy

[57] ABSTRACT

A surface-mounted electrical connector, or other contact assembly, has an insulative housing which supports one end of contact pins, in two rows, one above the other. The other end of each contact pin is bent back beneath itself to extend along the lower surface of the housing in channels separated from one another by walls. The lower end of each pin has an enlarged spherical knob which contacts a respective conductive region on the surface of a printed circuit board. The roofs of the channels are rounded to receive the knobs, the height of the channels being substantially the same as the diameter of the knobs. The rear end of each contact pin is inclined downwardly, in its natural state, to project below the housing, so that it is urged resiliently into contact with the conductive region during mounting. A bolt helps secure the connector to the board.

7 Claims, 5 Drawing Figures

18
22
43
40
3
50
42
2
43
51
6
4

43
40
43
41
43
2
24
18'
18
28'
28
10'
10
7
5
6
25
43
43

ELECTRICAL CONTACT ASSEMBLIES AND COMPONENTS

BACKGROUND OF THE INVENTION

This invention relates to electrical contact assemblies and components.

The invention is more specifically concerned with contacts of electrical components suitable for surface mounting on a printed circuit board.

Surface-mounted components are conventionally connected in a circuit formed on a printed circuit board by soldering their contacts to conductive tracks formed on the surface of the board. The soldered joint provides an electrical and may provide a mechanical connection of the components with the board. The contacts of such components usually take the form of a metal bar or strip of rectangular section that extends from one end of the component and is bent downwards at an angle from the component towards the conductive track on the board. These contacts may be terminated with a spherical knob as described in applicant's copending application Ser. No. 749,856 filed June 28, 1985, for Electrical Contact Elements, Connectors and Assemblies. Such an arrangement can provide an effective and low-cost contact but does sometimes have disadvantages.

Because the contacts project from one side of the component, the area occupied by the component with its contacts is relatively large. Also, difficulties can be experienced in accurately aligning the contacts with the conductive tracks on the board, and in ensuring that solder does not bridge tracks on the board. Alignment can be a particular problem with turned contacts of circular section since these do not have the lateral rigidity of rectangular section contacts. If the only mechanical connection of the component on the board is provided by the solder joint of the contacts with the conductive tracks, the resilience and length of the contacts can mean that there is a degree of freedom for movement of the component relative to the board. This may not be desirable in some circumstances, such as, for example, where the component has to align accurately with some other feature. The mechanical joint provided by the solder joint may no be very strong since the only force urging the contact against the board is provided by the resilience of the contact.

BRIEF SUMMARY OF THE INVENTION

It is an object of the present invention to provide a contact assembly which may be used to alleviate the above-mentioned difficulties.

According to the present invention there is provided an electrical contact assembly including an insulative housing and at least one contact element supported thereby, the or each said contact element being arranged to make electrical contact with a respective conductive region on the surface of an electrical circuit board, the lower surface of said housing being arranged to contact the said surface of the board, the or each contact element being in the form of an elongate member having one end mounted with said housing, and the other end bent back beneath itself to extend along the lower surface of the housing, the housing having a wall that extends along the lower surface of the housing on each side of the or each said contact element, and the said other end of the or each contact element being arranged to contact the respective conductive region on the board.

Preferably the said other end of the or each contact element has an enlarged portion of substantially spherical shape by which electrical connection to the conductive region is made. The said other end of the or each contact element may extend along a respective channel between the said walls, the roof of the or each said channel being rounded to receive the said enlarged portion. The height of the or each channel is preferably substantially the same as the diameter of the said enlarged portion.

The said other end of the or each contact element in its natural state, preferably projects below the lower surface of the housing and may be urged resiliently into contact with the respective conductive region on the board during mounting of the contact assembly on the board. The contact assembly may include a bolt by which the contact assembly can be secured to the circuit board. Where the assembly includes a plurality of contact elements, the said one end of the contact elements may be arranged in a plurality of rows one above the other in the housing, the said other end of the or each contact element associated with each respective row extending a different distance along the lower surface of the housing.

The contact assembly may be an electrical connector, and the said one end of the or each contact element may be a male pin element that projects beyond the said housing and is adapted for insertion within a cooperating female contact element.

An electrical connector assembly, in accordance with the present invention, will now be described, by way of example, with reference to the accompanying drawings.

DETAILED DESCRIPTION

Figure 1:
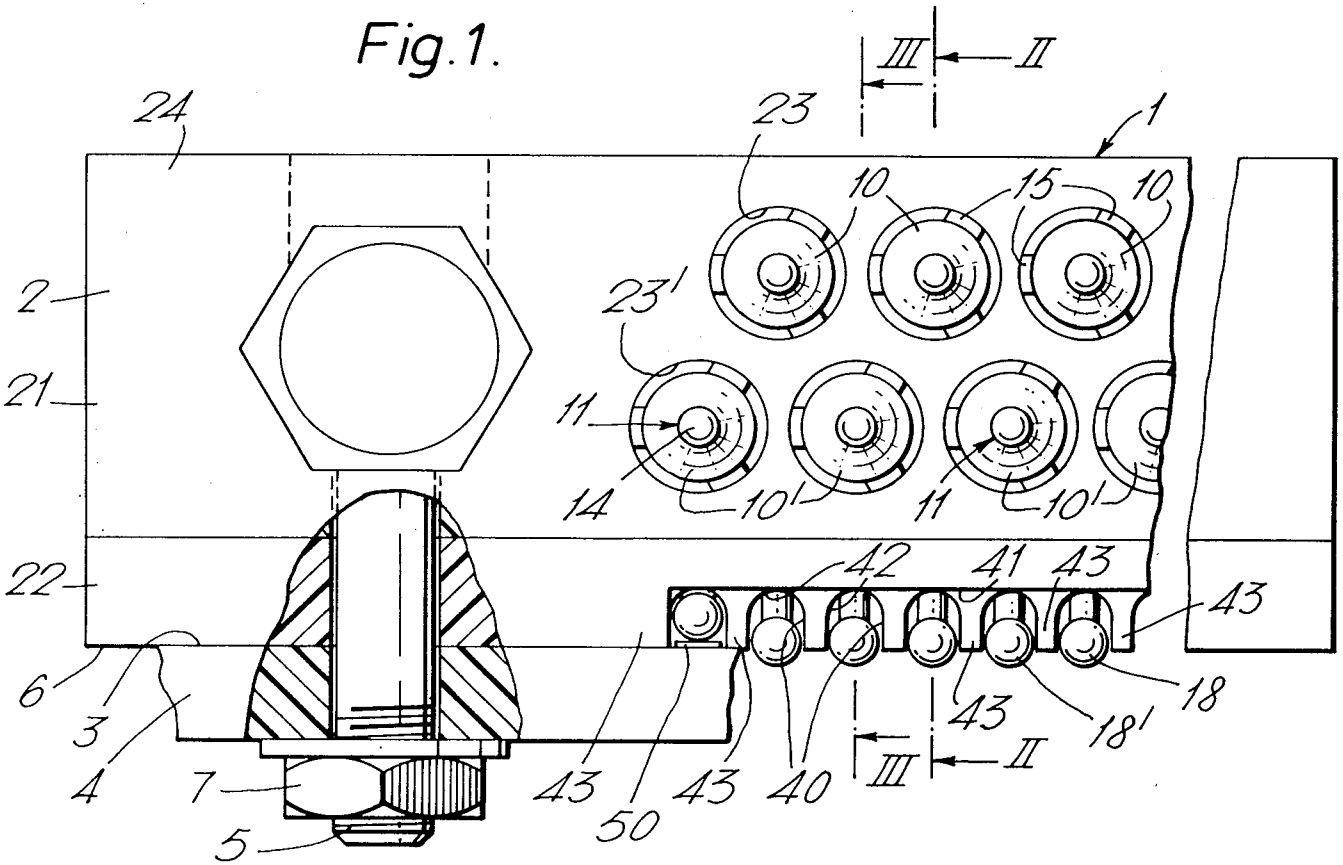
FIG. 1 is a partly cut-away front elevation showing the connector assembly on a board.

The connector assembly 1 comprises a plastics housing 2 containing an upper and lower row of male contact elements or pins 10 and 10' respectively that are adapted to mate with female contact elements or sockets in a cooperating connector (not shown). The connector 1 is mounted on the upper surface 3 of a printed circuit board 4 (FIG. 1) and is secured thereto by means of a bolt 5 that projects from the underside of the connector.

The housing 2 is of rectangular shape and section and is formed in two moulded parts 21 and 22. Lateral bores 23 and 23' extend entirely through the housing 2 between its front face 24 and rear face 25. Each bore 23 and 23' receives within it a respective one of the contact elements 10 and 10'. The contact elements 10 and 10 are of brass and comprise a forward section 11, an intermediate section 12 and a rear section 13. The forward section 11 projects from the forward face 24 of the housing 2, and is of cylindrical shape, having a rounded tip 14. The forward section provides that portion of the connector which engages within a socket in the cooperating connector.

The intermediate section 12 is of greater diameter than the forward section. The intermediate section 12 is located in the bore 23 by means of spring teeth 15 and an annular shoulder 16 which engage the front and rear ends respectively of a narrow region 26 of the bore 23.

Figure 2:
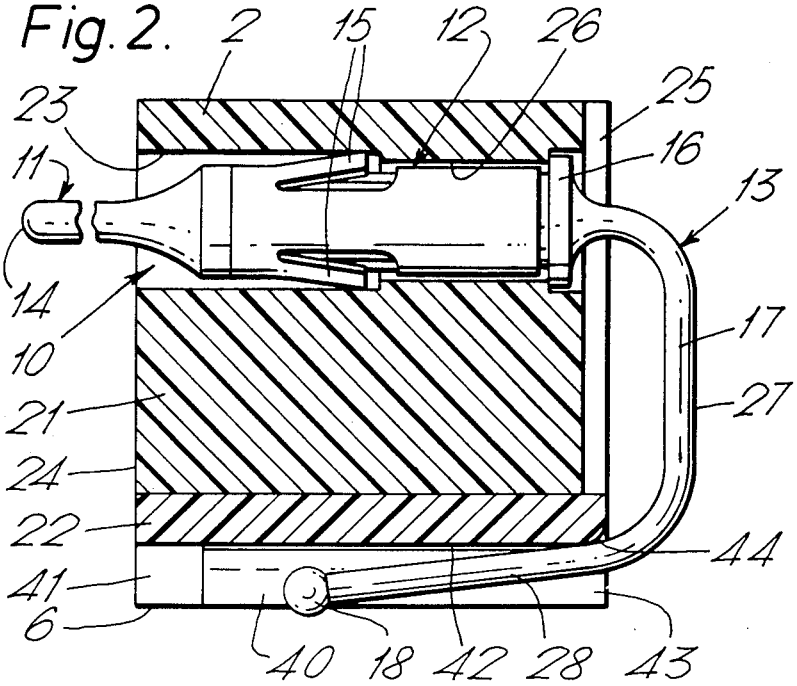
FIG. 2 is a sectional side elevation on the line II—II of FIG. 1.
Figure 3:
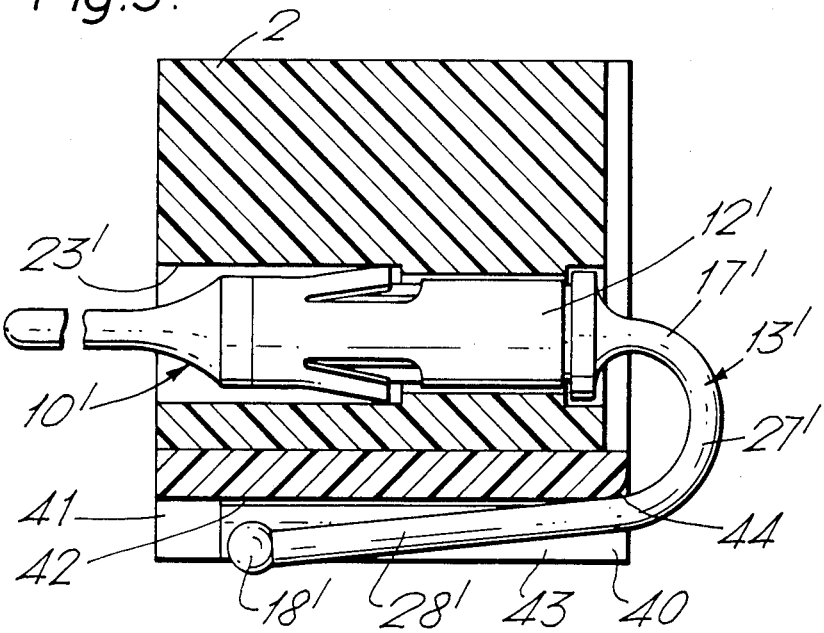
FIG. 3 is a sectional side elevation on the line III—III of FIG. 1

The rear section 13 of each contact element 10 is in the form of an elongate wire 17 of circular section and reduced diameter that is terminated at its rear end by an enlarged spherical knob 18. The wire 17 of each contact element 10 is bent back on the contact element, under itself, to extend along the lower surface 6 of the housing 2. The contact elements 10 in the upper row of bores 23, as shown in FIG. 2, are longer than the contact elements 10' in the lower row, as shown in FIG. 3.

With the upper contact elements 10, the wire 17 curves where it emerges from the rear end of the bore 23 and extends down the rear face 25 of the housing 2 in a straight vertical portion 27. At the lower end of the vertical portion 27, the wire 17 curves to merge with a straight lower section 28.

With the lower contact elements 10', by contrast, the straight lower section 28' of the wire 17' merges with the intermediate section 12' of the contact element via a curved section 27' alone.

In both the upper and lower contact elements 10 and 10' the lower section 28 and 28' is inclined from the horizontal so that, in its natural state, the knob 18 and 18' projects below the lower surface 6 of the housing 2. The knobs 18' of the lower contact elements 10 are located forwardly of the knobs 18 of the upper contact elements 10.

The lower surface 6 of the housing 2 is formed with lateral recesses or channels 40 which extend from the rear edge of the housing to within a short distance of the forward edge of the housing, where they open into a longitudinal recess 41 that extends along the lower edge of the front surface of the housing. The lower section 28 and 28' of each contact element 10 and 10' extends along a respective one of the channels 40, the width of each channel being just sufficient to accommodate the knob 18 and 18' of the contact elements. The roof 42 of each channel 40 is rounded and its height is substantially the same as the diameter of the knobs 18 and 18' of the contact elements 10 and 10' so that they can just be received in the channels. The walls 43 of adjacent channels thereby extend between adjacent ones of the contact elements 10 and 10' and keep them separate from each other. The rear edge 44 of the roof 42 of each channel 40 is rounded where it contacts the rear end of the lower section 28 and 28' of each wire 17 and 17'.

Figure 4:
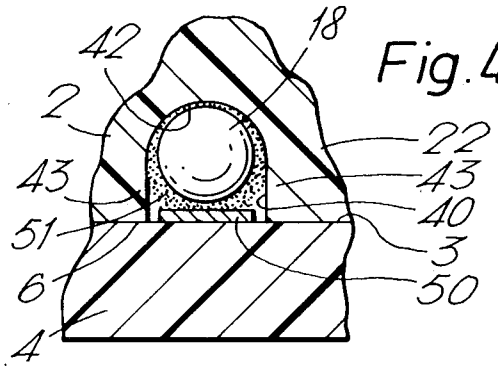
FIG. 4 is a sectional front elevation showing a part of the connector on a larger scale.
Figure 5:
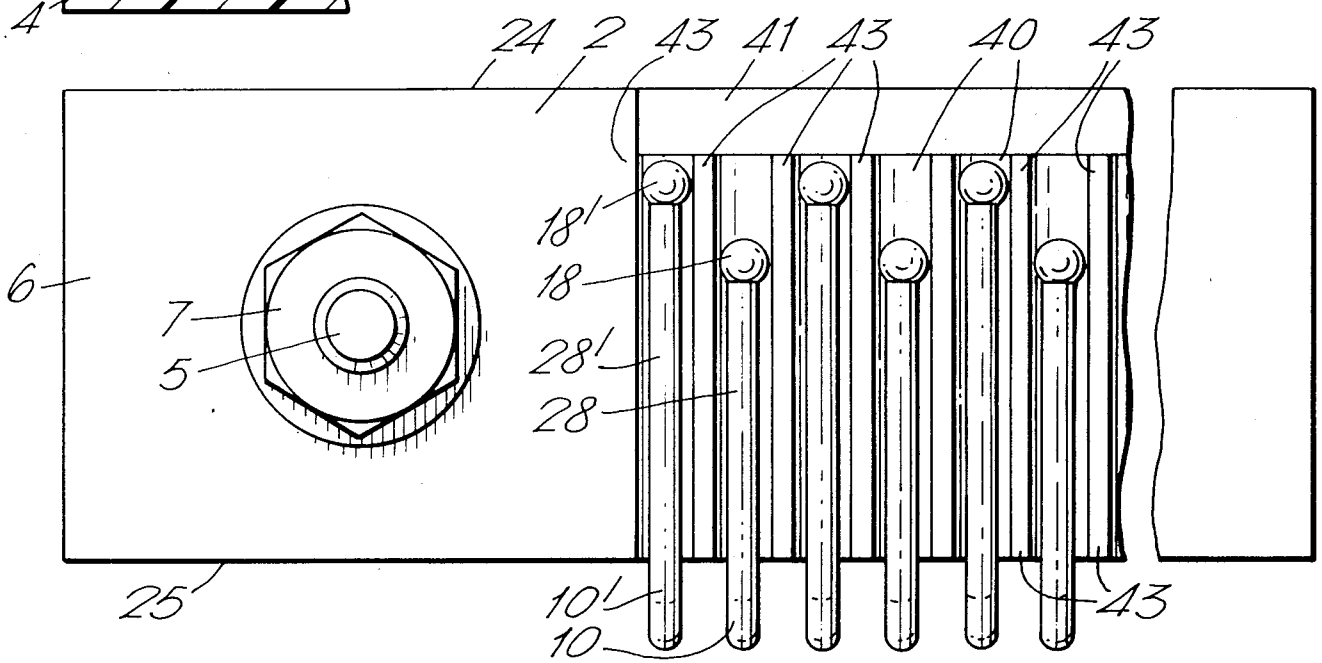
FIG. 5 shows the underside of the connector assembly.

The lower surface 6 of the connector 1 contacts the upper surface 3 of a board 4 which carries a number of conductive tracks 50 printed on, and raised above, the board surface (FIGS. 1 and 4). The pattern of the tracks 50 is selected to underlie the knobs 18 and 18' of the contact elements 10 and 10' so that each contact element makes electrical connection with a respective track.

Assembly of the connector 1 on the board 4 is achieved by first coating the conductive tracks 50 with a solder paste 51. The connector is then placed on the board 4 and pushed down against the resilience of the bent rear section 13 of the contact elements 10 and 10'. As the connector 1 is pushed down, the knobs 18 and 18' are pushed up into the channels 40, the walls 43 between channels aiding location between the raised conductive tracks 50 and preventing the lower sections 28 of the contact elements being deflected in the plane of the board 4.

The connector 1 is then secured to the board 4 by screwing a nut 7 onto the bolt 5 which projects from the underside of the board 4. The board 4 and connector 1 is then treated to vapour phase soldering which causes the solder paste 51 on the conductive tracks 50 to flow. As this happens, the resilience of the rear section 13 and 13' urges the knob 18 and 18' into the paste 51 which flows up around the knob, as shown in FIG. 4, substantially filling any interstices between the knob and the channel. The board 4 and connector 1 are then allowed to cool so that the solder hardens. In this respect, the materials of the connector are chosen to be capable of withstanding the temperature of the vapour phase soldering process.

By making contact with the board 4 beneath the connector 1, the space occupied by the connector on the board can be kept to a minimum. Also, if the bend of any of the contact elements is not accurate, such that the knob 18 or 18' does not project the correct distance below the housing 2, electrical contact with the tracks 50 on the board is still ensured because of engagement by the knob with the roof of its respective channel 40. The walls 43 of the channels 40 serve several functions, namely, to help register the connector 1 with the tracks 50 on the board, to ensure the contact elements are maintained in correct alignment, to insulate adjacent contact elements from one another, to prevent solder flowing between and bridging adjacent tracks, and mechanically to protect the solder joint between the contact elements and tracks. Because the solder fills any gap between the knobs 18 and 18' and the channels 40 it provides a good mechanical joint between the board 4 and the housing 2.

It will be appreciated that the contact elements could be in the form of sockets instead of pins and that the invention is not confined to use with electrical connectors but could be used with other electrical components. Various modifications could be made to the connector. For example, the housing could be extended rearwardly such that the bent portion of the contact elements extend within vertical channels up the rear face of the housing. The housing could be made as a single component and the contact element or elements could be secured within the housing in various different ways. The conductive tracks on the board could be flush with the surface of the board and could be wider than the channels in the housing.

What I claim is:

1. An electrical contact assembly comprising an insulative housing having a lower surface that is arranged for mounting on the surface of an electrical circuit board and at least one contact element having one end supported by the housing, the other end of the or each said contact element being of circular section along the major part of its length, the said other end being bent back beneath itself along the lower surface of the housing, said other end of the or each said contact element contacting and being joined to a respective conductive region on the surface of the electrical circuit board by means of a settable, electrically-conductive joint material, the said other end of the or each said contact element having an enlarged portion of substantially spherical shape, the housing including a plurlity of walls that extend along the lower surface of the housing and define respective channels therebetween along the said lower surface of the housing, and each said channel having a roof that is rounded to receive the said enlarged spherical portion of a respective contact element so that the said joint material flows over and around the said enlarged spherical portion to substantially fill any space between the said enlarged portion and the respective channel in which said enlarged portion is located.

2. An electrical contact assembly according to claim 1, wherein the or each said contact element is inclined downwardly towards its said other end.

3. An electrical contact assembly according to claim 1, wherein the said other end of the or each said contact element in its natural state, projects below the lower surface of the housing.

4. An electrical contact assembly according to claim 1, wherein the said other end of the or each said contact element is urged resiliently into contact with the respective conductive region on the said circuit board during mounting of the contact assembly on the board.

5. An electrical contact assembly according to claim 1, including a bolt for securing the contact assembly to the circuit board.

6. An electrical contact assembly according to claim 1, including a plurality of contact elements, wherein the said one end of the contact elements are arranged in a plurality of rows one above the other in the housing, and wherein the said other end of the or each said contact element associated with each respective row extends a different distance along the lower surface of the housing.

7. An electrical connector according to claim 1, wherein the said one end of the or each contact element is a male pin element that projects beyond the said housing.

* * * * *